United States Patent [19]

Weber et al.

[11] Patent Number: 4,464,831

[45] Date of Patent: Aug. 14, 1984

[54] METHOD AND DEVICE FOR FABRICATING INSULATED JOINTS FOR RAILROAD TRACKS

[75] Inventors: Lothar Weber, Hörner Weg; Friedhelm Wojtek, Zum Ortenbrink; Horst Schwarzbach, Feldkamp, all of Fed. Rep. of Germany

[73] Assignee: Klöckner-Werke Aktiengesellschaft, Duisburg, Fed. Rep. of Germany

[21] Appl. No.: 347,420

[22] Filed: Feb. 10, 1982

[30] Foreign Application Priority Data

Feb. 11, 1981 [DE] Fed. Rep. of Germany ..... 3104801

[51] Int. Cl.[3] ..... H01R 43/00; B23P 19/00

[52] U.S. Cl. ..... 29/825; 29/745; 156/82; 156/92; 156/381; 156/497; 156/499; 238/159; 238/160; 238/161; 238/243; 432/10; 432/225

[58] Field of Search ..... 29/825, 745; 238/159, 238/160, 161, 152, 243; 432/10, 225; 269/43, 253; 83/71; 156/82, 91, 92, 304.3, 322, 381, 497, 499; 191/22 R, 22 C, 29 R, 32, 39

[56] References Cited

U.S. PATENT DOCUMENTS

| | | | |
|---|---|---|---|
| 715,813 | 12/1902 | Karns | 238/160 |
| 937,369 | 10/1909 | Hall | 238/160 |
| 969,856 | 9/1910 | Griffith | 238/159 |
| 997,475 | 7/1911 | Ten Eyck | 238/159 X |
| 2,075,982 | 4/1937 | George | 432/10 X |
| 2,173,618 | 9/1939 | Ahlert | 432/225 X |
| 2,242,882 | 5/1941 | George | 432/10 X |
| 2,670,136 | 2/1954 | Moses | 238/160 X |
| 3,300,197 | 1/1967 | Rutherford et al. | 432/10 X |
| 3,837,948 | 9/1974 | Nelson et al. | 238/152 X |
| 4,292,110 | 9/1981 | Marteness | 238/160 X |

FOREIGN PATENT DOCUMENTS

| | | | |
|---|---|---|---|
| 1004214 | 3/1957 | Fed. Rep. of Germany | 238/243 |

*Primary Examiner*—Howard N. Goldberg
*Assistant Examiner*—Carl J. Arbes
*Attorney, Agent, or Firm*—Watson, Cole, Grindle & Watson

[57] ABSTRACT

A method of fabricating an insulating joint between a pair of end abutting rail sections of a railroad track includes the suspension of a pair of opposed fishplates at the rail joint at spaced distances outwardly of the rail sides, and simultaneously heating the rail sections and the fishplates to a predetermined temperature for activating a heat-activatable adhesive provided in fabric cuffs which are disposed between the fish surfaces and the fishplates. The fishplates are shifted along guide rods of their support assemblies inwardly toward one another into place against opposed fish surfaces of the rail sections, and are thereafter bolted in place. A device for fabricating the joint includes a box-like hood on which heaters are mounted, or a shear assembly supporting the heaters and being clamped onto the rail head. The heaters may be adjusted to accommodate various rail profiles.

15 Claims, 3 Drawing Figures

METHOD AND DEVICE FOR FABRICATING INSULATED JOINTS FOR RAILROAD TRACKS

BACKGROUND OF THE INVENTION

This invention relates to a method and a device for fabricating an insulated joint between a pair of end abutting rail sections of a railroad track.

For train safety purposes, it is frequently necessary to divide the railroad track into insulated track sections for which purpose insulated joints are fabricated into the tracks.

There are basically three different known types of insulated joints. For example, in an insulated adhesive butt joint, a two-component adhesive is thickly applied to the metal-smooth back side of the fishplate and a layer of glass fiber fabric is set into the moist adhesive. Then, an insulation lining is thickly coated on its inner surface with an adhesive and is placed on the layer of glass fiber fabric over the fishplate. After the insulation lining has been thickly coated with adhesive also on its outer surface and a layer of glass fiber fabric has been applied thereto, the smooth fish surfaces of the abutting rail sections are thickly coated with adhesive and the pretreated fishplates are then disposed against the opposed coated fish surfaces and are mounted in place with the use of fasteners.

In another known, insulated, steel fishplate butt joint arrangement, the fish surfaces in the area of the insulated joint are the protective casings of the insulated steel fishplates are ground metallically smooth and a mortar mass mixed from resin and hardener is applied with a wedge shaped spatula to the dry inner surfaces of the insulated steel fishplates, is compressed and then profiled. The fishplate screws are then inserted through aligned bores in the fishplates and webs of the abutting rail sections and are thereafter tightened.

In still another known embodiment of an insulated rail joint, an insulation cuff is inserted between each fishplate and the rail after the rail sections and fishplates have been sequentially heated. Such a cuff consists of a layer of fabric and a heat-activatable adhesive which is activated when the joint is heated to a predetermined temperature for approximately 20 minutes to thereby constitute an adhesive joint.

This latter type joint has the particular advantage relative to other known joints in that the two-component adhesive which is used, having a certain pot life, need not be made in situ, but is readily available as a cuff and need merely be heated in order to be activated. However, fabrication of this insulated rail joint requires the rail sections and the fishplate surfaces which are to be adhered together to be cleaned, followed by the heating to a predetermined temperature of first the rail sections and then the fishplates. Then, immediately after the cuff is placed into the space between the fishplate and the rail, the fishplate is inserted against the fish surface and screws are inserted through the aligned bore holes. The fishplate must then be held stationary on one side by the operator. Then, the cuff is introduced on the opposite side of the rail between the fish surfaces and the fishplate and the fishplate is moved onto the screw bolts until this opposed fishplate also bears against the fish surfaces.

However, a disadvantage in this fabrication technique is that it is relatively time consuming because the rail sections and the fishplates must be heated one after the other. It also requires additional personnel since one workman is needed to steadily hold one fishplate in place while another workman must install the opposed fishplate over the screw bolts from the opposite side. This operation is rendered all the more difficult because of the applied heating temperature of about 200° C.

SUMMARY OF THE INVENTION

It is therefore an object of the present invention to provide a method of fabricating an insulated joint between a pair of end abutting rail sections of a railroad track which considerably reduces the production time required, simplifies the assembly operation, and assures at the same time a most reliable insulated rail joint.

In accordance with the present method, a pair of metallic fishplates are suspended at the joint between the rail sections at a position spaced outwardly from the opposed fish surfaces thereof, the rail sections and the fishplates at such position are simultaneously heated to a predetermined temperature, a layer of insulating material is disposed between confronting ends of the rail sections, a pair of cuffs are respectively disposed between the fishplates and fish surfaces, the cuffs comprising fabric and heat-activatable plastic material which is activated at such predetermined temperature, the fishplates are shifted toward one another against the fish surfaces with the cuffs lying therebetween, sleeves of insulating material are inserted into aligned bores in the fishplates and in the webs of the rail sections, and fasteners are extended through the sleeves for securing the fishplates to the rail sections.

Another object of the invention is to provide a device for fabricating an insulated joint between a pair of end abutting rail sections which effects a considerably more rapid and simpler production of the insulated rail joint as well as assuring a high quality and reliable joint.

The device according to the invention includes a pair of support members at the joint respectively spaced outwardly of the sides of the rail sections, the fishplates are mounted on the support members at spaced distances from the rail sections and at a predetermined height for shifting movement against the fish sides of the rail sections. Heaters are mounted on a holder for simultaneously heating the rail sections and the fishplates, the heaters being angularly disposed relative to the rail sections so as to extend toward spaces between the rail sections and the fishplates to effect simultaneous heating.

Other objects, advantages and novel features of the invention will become more apparent from the following detailed description of the invention when taken in conjunction with the accompanying drawings.

DETAILED DESCRIPTION OF THE INVENTION

Figure 1:
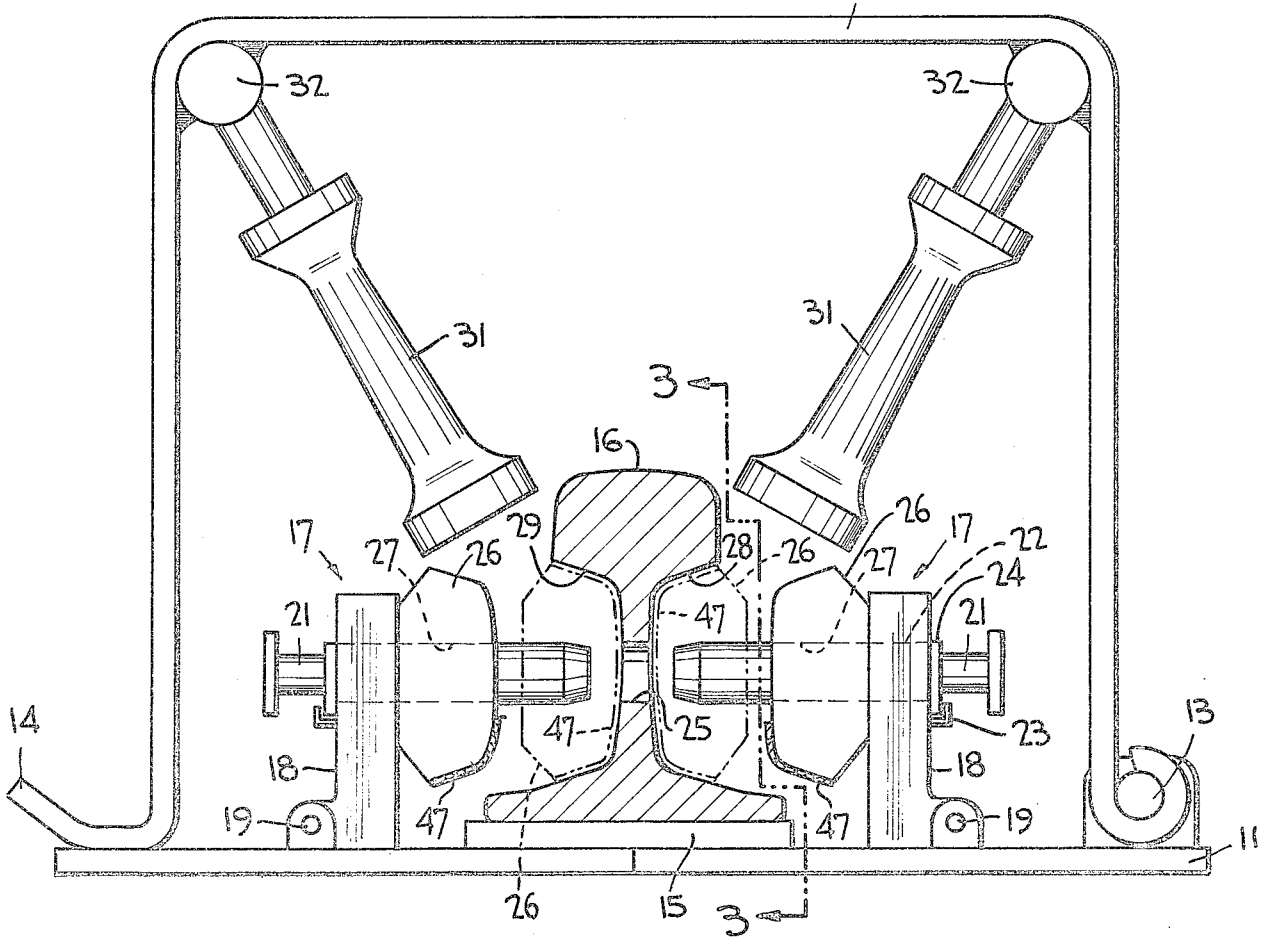
FIG. 1 is an end elevational view of the device according to one embodiment of the invention, the rail being shown in section.

Turning now to the drawings wherein like reference characters refer to like and corresponding parts throughout the several views, the first embodiment of the device according to the invention shown in FIG. 1 includes a base plate 11 on which a box-like hood 12 is pivotally mounted at one end as at 13, and is provided with a handle 14 at its opposite end to facilitate a lifting and lowering of the hood. A support plate 15 is mounted on the base plate, and end abutting rail sections 16, 16*a* rest on the support plate. Support assemblies 17 are mounted on base plate 11 at opposite sides of the rail sections and at spaced distances therefrom. Each assembly includes an upstanding support 18 which may be adjusted in height in any normal manner in order to adapt to different rail profiles. Otherwise, supports 18 of predetermined height may be interchanged depending on the specific profiles of the rail sections to be insulated, and the supports are mounted for pivotal movement as at 19 so that each assembly may be pivoted away from the rail after the joint fabricating operation.

Figure 3:
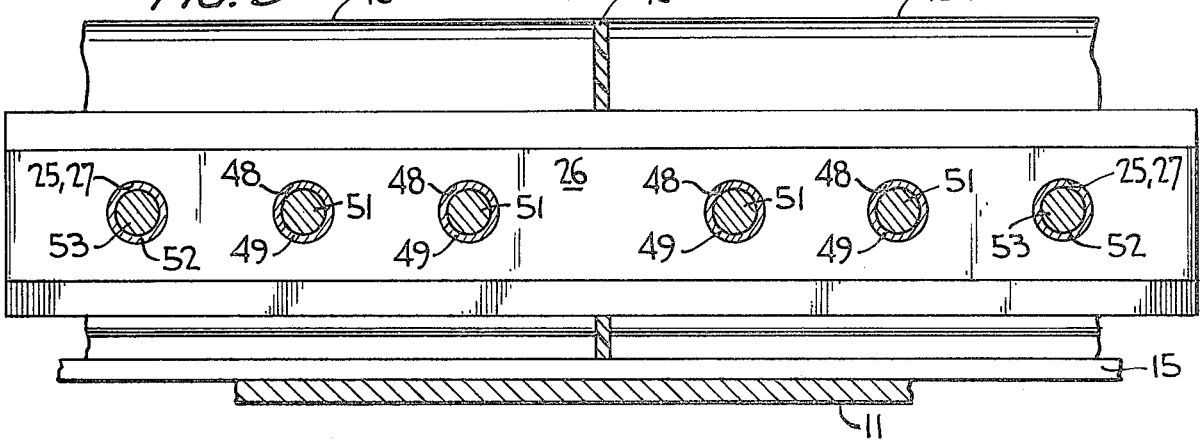
FIG. 3 is a side elevational view of the insulated joint between a pair of end abutting rail sections, fabricated according to the invention, and taken substantially along the line 3—3 of FIG. 1.

Each support assembly further includes a horizontally disposed guide rod 21 extending through a bore 22 in support 18 and being fixed thereon by means of a clip 23 or the like engaging a ring 24 on the rod which abuts against the outer surface of support 18. A pair of guide rods 21 are preferably mounted on each support 18 and are respectively aligned with boreholes 25 (see also FIG. 3) provided in the webs of the end adjoining rail sections. A metallic fishplate 26, having boreholes 27 in alignment with boreholes 25, is suspended on each support assembly in the position of FIG. 1 as guide rods 21 extend therethrough. The confronting surfaces of the opposed fishplates are shaped to correspond to the profile of the opposed fish surfaces 28, 29 of the rail sections.

The rail sections and the fishplates are simultaneously heated to a predetermined temperature on opposing sides of the rail by means of gas heaters 31 which may be fixedly mounted at the four corners of the box-like hood 12 or may be pivotably mounted thereon, as at 32, to accommodate differently sized rails. In either case, the heaters are angularly disposed relative to the rail for directing heat out of the forward ends into the spaces between the rail sections and fishplates, substantially as shown.

Figure 2:
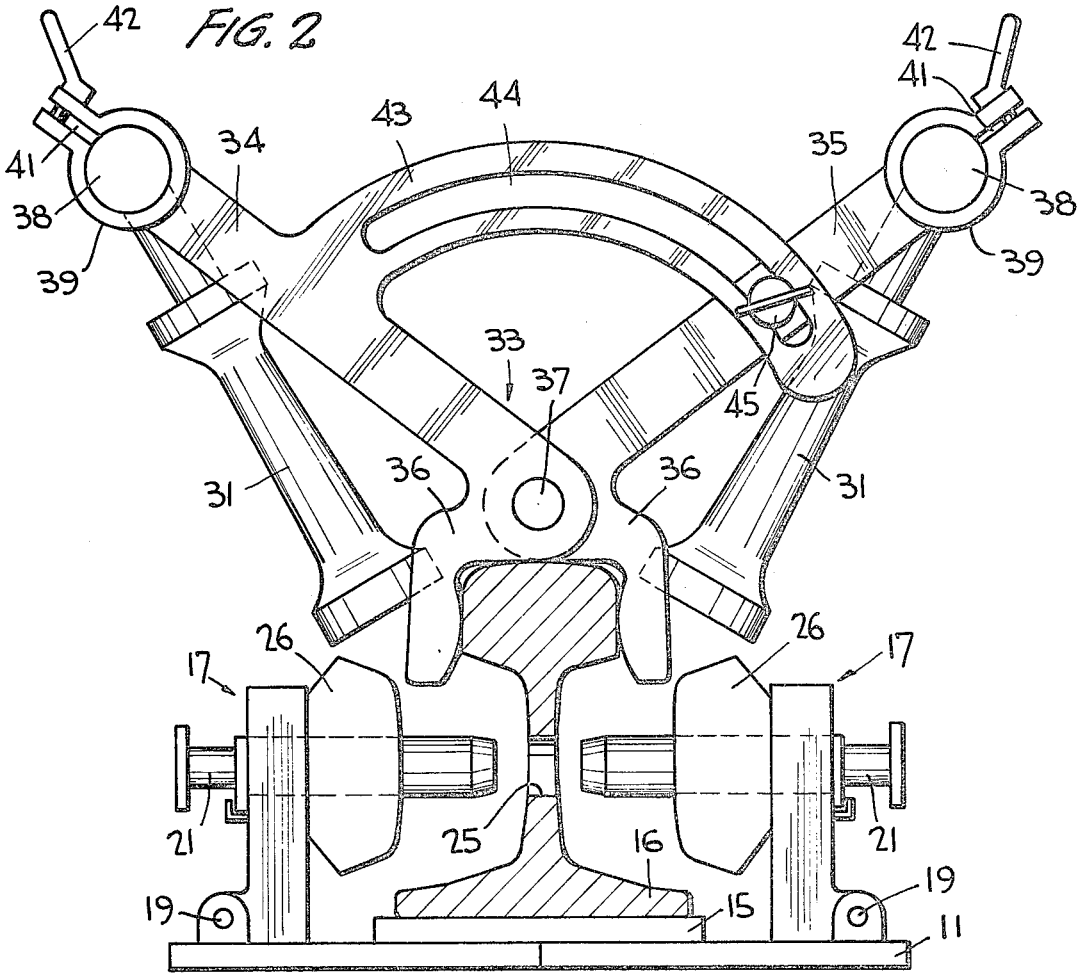
FIG. 2 is an end elevational view of the device according to another embodiment of the invention, the rail being shown in section.

The FIG. 1 embodiment is basically a closed device, while that of FIG. 2 is an open device. Here, each support assembly 17 is identical to that described with reference to FIG. 1, so that like references numerals have been applied in the drawings. However, heaters 31 are mounted at their outer ends to a shear assembly 33 having a pair of arms 34, 35 and gripping jaws 36 at their inner ends. The jaws engage the rail head for supporting the heaters in place, and the arms of the shear members are hinged together as at 37. Axles 38 are mounted for pivotal movement about their central axes at the outer ends of the shear arms within split clamp rings 39, and heaters 31 are mounted on these axles. The split rings are spaced apart as at 41 and are tightened by means of toggle fasteners 42. Thus, the angularity of the burners may be adjusted relative to the rail to accommodate differently sized rail sections.

An arcuate ring segment 43 extends from arm 34 and overlaps with arm 35. This segment includes an arcuate slot 44, and a thumbscrew 45 or the like on arm 35 extends through this slot for tightening jaws 36 against the rail head. Shear assembly 33 may include a single pair of arms with axles 38 extending outwardly of opposite sides thereof with a two or more heaters 31 extending from each axle, or the shear assembly may comprise a pair of spaced arms 34, 35 interconnected by axles 38 from which the heaters extend. Certainly, the numbers of heaters provided on each side of the rail depends, among other things, on the length of the fishplates. Moreover, use of several burners can produce the needed quantity of heat more rapidly and more evenly.

In fabricating an insulated rail joint according to the invention, cleaned rail sections 16 and 16*a* are placed together end-to-end and support assemblies 17 for the cleaned fishplates are adjusted in height (in any normal manner) to the rail profile, so that guide rods 21 are aligned with bore holes 25 in the rail sections. Heaters 31, of either embodiment, are then angularly adjusted depending on the rail size for directing heat into the spaces between the rail sections and the fishplates and onto the fishing surfaces and fishplates, substantially as shown in FIGS. 1 and 2. The rail sections and the fishplates on opposite sides thereof may thus be simultaneously heated in an energy-saving manner and as evenly as possible, to about 180° to 200° C. This temperature, which is considerably higher than the activation temperature of the adhesive, is necessary because of heat losses. And, the temperature level may be monitored with a thermocolor pencil.

After this temperature has been reached, a layer 46 (FIG. 3) of insulating material is disposed between the confronting ends of the rail sections, this layer having a shape corresponding to the rail profile. And, cuffs 47 comprised of fabric and heat-activatable adhesive are placed on the fishplates shown only in FIG. 1 but omitted in FIG. 2 for clarity, whereupon the heated fishplates are horizontally shifted in any suitable manner on their guide rods 21 against the fish surfaces and to the phantom outline positions of FIG. 1. The fishplates are adhesively secured in place via the adhesive of the cuffs which is heat activated by the hot rail sections and fishplates. Additional aligned bores 48, previously provided in the webs of the rail sections and in the fishplates (FIG. 3), are accessible for the insertion of sleeves 49 of insulating material. Elongated bolts 51 are then extended through the sleeves and nuts are tightened thereon for securely mounting the opposed fishplates in place. Guide rods 21 are then retracted by sliding them outwardly of each support assembly 17 upon disengagement between clips 23 and rings 24. Sleeves 52 of insulating material (FIG. 3) are then inserted through aligned bore holes 25, 27 after which elongated bolts 53 are extended through the sleeves and nuts are tightened thereon for further mounting the fishplates in place.

Many important advantages are attributed to the present invention. For example, rail sections 16, 16*a* and the opposed fishplates 26 which span the joint therebetween are simultaneously heated in a short period of time and in an even manner which is important for the quality of the insulated rail joint. By simply shifting the hot fishplates inwardly toward one another on their guide rods 21 reduces to a minimum the amount of handling of hot parts by the operator so that the entire fabrication time can be considerably reduced. The present method and devices of the invention can be utilized for any rail profile, both in the factory and at the construction site, so that even the operation at the construction site, which was always performed under difficult conditions, is made considerably easier by the invention. And, the devices are relatively simple to construct thereby rendering them easy to handle at the construction site. In addition, they can be rapidly adapted to other rail profiles, for example, by making the support assemblies 17 adjustable in height or interchangeable in some suitable manner. Moreover, the operation of the device is considerably simplified as the support assemblies are capable of being pivoted out of their work positions.

Obviously, many other modifications and variations of the present invention are made possible in the light of the above teachings. It is therefore to be understood that within the scope of the appended claims the invention may be practiced otherwise than as specifically described.

What is claimed is:

1. A method of fabricating an insulated joint between a pair of end abutting rail sections of a railroad track, comprising the steps of:

providing an opposed pair of guide rods lying in a plane parallel to a plane of the top surface of rail sections and secured onto support means providing at least first and second bores in each of a pair of fishplates and at least first and second bores in confronting ends of each of the rail sections, the rail section bores and the fishplate bores being in alignment with one another;

suspending the fishplates, by extending the opposed pair of rods through said second bores thereof, at the joint at a position spaced outwardly from opposed fish surfaces of the rail sections, the surfaces of the fishplates confronting the fish surfaces and corresponding in shape thereto;

simultaneously heating the rail sections and the fishplates at said position to a predetermined temperature;

disposing a layer of insulating material between confronting ends of the rail sections, the layer having a shape corresponding to the rail profile;

disposing a pair of cuffs respectively between said fishplates and said fish surfaces, the cuffs comprising fabric and heat-activatable plastic material which is activated at said predetermined temperature;

shifting the fishplates along the guide rods toward one another against the fish surfaces with the cuffs lying therebetween;

inserting first sleeves of insulating material into said first aligned bores; and extending fasteners through said sleeves for securing the fishplates to the rail sections.

2. The method according to claim 1, wherein the rail sections and fishplates are heated by heating devices secured onto securing means extending toward the spacings between the rail sections and the fishplates.

3. The method according to claim 1, comprising the further steps of removing the guide rods from the fishplates after the same are shifted therealong, inserting second sleeves of insulating material through said second aligned bores, and extending fasteners through said second sleeves for further securing the fishplates to the rail sections.

4. A device for fabricating an insulated joint between a pair of ends abutting rail sections of a railway track, comprising a base plate adapted for supporting the rail sections, a pair of spaced apart support assemblies mounted on said plate at the joint, said assemblies comprising upstanding supports and elongated guide rods fixedly mounted thereon, said rods lying parallel to said base plate and having terminal ends respectively spaced outwardly of the sides of the rail sections, said rods being coaxial and being spaced above said base plate a predetermined distance adapted for aligning said rods with a bore located in one of the rail sections, said rods being adapted for suspending fishplates having bores therein through which said rods are capable of extending so that the fishplates may be guided along said rods against the fish surfaces of the rail sections, cuffs of fabric and heat-activatable material adapted to be disposed between the fish surfaces and the fishplates, a hood mounted on said base plate and overlying said support assemblies, heater members mounted on said hood for diverting heat toward said cuffs for heat activating same.

5. The device according to claim 4, wherein said heater members are mounted at the corners of said hood.

6. The device according to claim 4, wherein said hood is pivotally mounted on said base plate.

7. The device according to claim 1, wherein said heater members are pivotally mounted at one end on said hood.

8. The device according to claim 4, wherein said upstanding supports are mounted on said base plate for pivotal movement about axes lying parallel to said plate and perpendicular to said rods.

9. A device for fabricating an insulated joint between a pair of end abutting rail sections of a railway track, comprising a base plate adapted for supporting the rail sections, a pair of spaced apart support assemblies mounted on said plate at the joint, said assemblies comprising upstanding supports and elongated guide rods fixedly mounted thereon, said rods lying parallel to said base plate and having terminal ends respectively spaced outwardly of the sides of the rail sections, said rods being coaxial and being spaced above said base plate a predetermined distance adapted for aligning said rods with a bore located in one of the rail sections, said rods being adapted for suspending fishplates having bores therein through which said rods are capable of extending so that the fishplates may be guided along said rods against the fish surfaces of the rail sections, cuffs of fabric and heat-activatable material adapted to be disposed between the fish surfaces and the fishplates, at least one shear assembly having interconnected jaws mounted above said support assemblies by engaging a rail head of one of the rail sections, heater members mounted on said shear assembly for directing heat toward said cuffs for heat activating same.

10. The device according to claim 9, wherein said shear assembly includes means for adjusting said jaws to accomodate the width of the rail head.

11. The device according to claim 9, wherein a pair of spaced shear assemblies having jaws are mounted above said support assemblies by engaging a rail head of the one rail section, axles interconnecting ends of said jaws of said respective shear assemblies, said heaters being mounted on said axles.

12. The device according to claim 9, wherein axles are mounted at the outer ends of said jaws and extend outwardly of opposite sides thereof, said heaters being mounted on said axles.

13. The device according to claim 10, wherein said adjusting means comprises a ring segment having an arcuate slot extending from one of said arms to the other, a fastener on said other arm extending through said slot for adjusting the relative angularity between said arm.

14. The device according to claim 11, wherein said ends of said jaws include split ring clamps surrounding said axles, and toggle bolts engage said clamps for adjusting the angularity of said heaters.

15. The device according to claim 12, wherein said ends of said jaws include split ring clamps surrounding said axles, and toggle bolts engage said clamps for adjusting the angularity of said heaters.

* * * * *